US009584895B2

(12) United States Patent
Blanchard

(10) Patent No.: US 9,584,895 B2
(45) Date of Patent: Feb. 28, 2017

(54) TEARDROP VARIABLE WALL EARBUD

(71) Applicant: Klipsch Group, Inc., Indianapolis, IN (US)

(72) Inventor: Mark A. Blanchard, Lebanon, IN (US)

(73) Assignee: Klipsch Group, Inc., Indianapolis, IN (US)

( * ) Notice: Subject to any disclaimer, the term of this patent is extended or adjusted under 35 U.S.C. 154(b) by 171 days.

(21) Appl. No.: 13/966,827

(22) Filed: Aug. 14, 2013

(65) Prior Publication Data

US 2015/0049897 A1 Feb. 19, 2015

(51) Int. Cl.
*H04R 25/00* (2006.01)
*H04R 1/10* (2006.01)

(52) U.S. Cl.
CPC ..... *H04R 1/1016* (2013.01); *H04R 25/656* (2013.01); *H04R 1/1083* (2013.01)

(58) Field of Classification Search
CPC .... H04R 25/65; H04R 25/652; H04R 1/1016; H04R 1/1083
See application file for complete search history.

(56) References Cited

U.S. PATENT DOCUMENTS

| | | | |
|---|---|---|---|
| 177,253 | A | 5/1876 | Keats |
| 789,876 | A | 5/1905 | Pape |
| 1,556,775 | A | 10/1925 | Fensky |
| 2,246,737 | A | 6/1941 | Knudsen |
| 2,430,229 | A | 11/1947 | Kelsey |
| 2,487,038 | A | 11/1949 | Baum |
| 2,521,414 | A | 9/1950 | Schier |
| 2,719,523 | A | 10/1955 | Von Glerke |
| 2,987,584 | A | 6/1961 | Webber |
| 3,061,689 | A | 10/1962 | McCarrell et al. |
| 3,080,011 | A | 3/1963 | Henderson |
| D207,216 | S | 3/1967 | Geib |
| RE26,258 | E | 8/1967 | Martin |
| 3,414,685 | A | 12/1968 | Geib et al. |
| 3,415,246 | A | 12/1968 | Hill |
| 3,548,118 | A | 12/1970 | Hutchings |
| 3,610,841 | A | 10/1971 | Hutchings |
| 3,618,697 | A | 11/1971 | Littmann |
| 3,692,958 | A | 9/1972 | Dymoke |

(Continued)

FOREIGN PATENT DOCUMENTS

| | | |
|---|---|---|
| EP | 0959773 B1 | 12/2003 |
| EP | 1578168 A3 | 9/2005 |

(Continued)

*Primary Examiner* — Duc Nguyen
*Assistant Examiner* — Taunya McCarty
(74) *Attorney, Agent, or Firm* — Indiano & McConnell LLP

(57) ABSTRACT

An ear tip is disclosed that comprises an annular flange having a first end tapering downwardly to a second end and having a teardrop curve lateral cross section running from approximately the upper end to the lower end. An inner body extends internally from the upper end within a hollow interior defined by the flange toward the lower end. An acoustic channel extends through the inner body. The flange at least partially occludes an ear canal from ambient noise and creates at least a partial air seal in the ear canal and the acoustic channel is configured to allow the passage of sound into the ear canal when the inner body is connected with a sound source.

13 Claims, 4 Drawing Sheets

(56) References Cited

U.S. PATENT DOCUMENTS

| | | | |
|---|---|---|---|
| 3,865,998 | A | 2/1975 | Weiss et al. |
| 3,993,879 | A | 11/1976 | Larkin |
| 4,006,321 | A | 2/1977 | Carlson |
| D245,202 | S | 7/1977 | Asker |
| 4,039,765 | A | 8/1977 | Tichy et al. |
| 4,122,841 | A | 10/1978 | Rock et al. |
| 4,261,432 | A | 4/1981 | Gunterman |
| D259,279 | S | 5/1981 | Takeda |
| 4,325,453 | A | 4/1982 | Moussette |
| 4,335,281 | A | 6/1982 | Scott et al. |
| 4,347,911 | A | 9/1982 | Bertagna et al. |
| 4,548,082 | A | 10/1985 | Engebretson et al. |
| 4,677,675 | A | 6/1987 | Killion et al. |
| 4,764,168 | A | 8/1988 | Suh |
| D298,356 | S | 11/1988 | Falco |
| 4,867,149 | A | 9/1989 | Falco |
| 4,870,688 | A | 9/1989 | Voroba et al. |
| 4,875,233 | A | 10/1989 | Derhaag et al. |
| 4,913,259 | A | 4/1990 | Packard |
| 4,936,411 | A | 6/1990 | Leonard |
| 5,031,219 | A | 7/1991 | Ward et al. |
| D330,761 | S | 11/1992 | Falco |
| 5,188,123 | A | 2/1993 | Gardner, Jr. |
| 5,201,007 | A | 4/1993 | Ward et al. |
| 5,288,953 | A | 2/1994 | Peart |
| 5,295,193 | A | 3/1994 | Ono |
| 5,298,692 | A | 3/1994 | Ikeda et al. |
| D353,379 | S | 12/1994 | Nakamura et al. |
| 5,487,012 | A | 1/1996 | Topholm et al. |
| 5,692,059 | A | 11/1997 | Kruger |
| 5,712,453 | A | 1/1998 | Bungardt et al. |
| 5,781,638 | A | 7/1998 | Hosaka et al. |
| 5,824,968 | A | 10/1998 | Packard et al. |
| D402,752 | S | 12/1998 | Falco |
| 5,917,918 | A | 6/1999 | Callahan |
| 5,957,136 | A | 9/1999 | Magidson et al. |
| 5,979,589 | A | 11/1999 | Aceti |
| D427,304 | S | 6/2000 | Magidson et al. |
| 6,175,633 | B1 | 1/2001 | Morrill et al. |
| 6,205,227 | B1 | 3/2001 | Mahoney et al. |
| 6,253,871 | B1 | 7/2001 | Aceti |
| 6,258,043 | B1 | 7/2001 | Raviv et al. |
| 6,359,993 | B2 | 3/2002 | Brimhall |
| D468,299 | S | 1/2003 | Boesen |
| D468,721 | S | 1/2003 | Nguyen |
| 6,513,621 | B1 | 2/2003 | Deslauriers et al. |
| 6,532,295 | B1 | 3/2003 | Brimhall et al. |
| D473,652 | S | 4/2003 | Darley et al. |
| 6,574,345 | B1 | 6/2003 | Huang |
| 6,643,378 | B2 | 11/2003 | Schumaier |
| 6,648,813 | B2 | 11/2003 | Zilberman et al. |
| 6,688,421 | B2 | 2/2004 | Dyer et al. |
| 6,695,093 | B1 | 2/2004 | Falco |
| 6,751,327 | B1 | 6/2004 | Urso et al. |
| D499,397 | S | 12/2004 | Hlas et al. |
| 6,920,228 | B2 | 7/2005 | Redmer et al. |
| 6,920,229 | B2 | 7/2005 | Boesen |
| 6,940,988 | B1 | 9/2005 | Shennib et al. |
| D517,054 | S | 3/2006 | Yang |
| 7,010,137 | B1 | 3/2006 | Leedom et al. |
| 7,072,476 | B2 | 7/2006 | White et al. |
| 7,079,662 | B2 | 7/2006 | Niederdränk |
| 7,082,206 | B2 | 7/2006 | Mahoney et al. |
| 7,092,543 | B1 | 8/2006 | Mahoney et al. |
| 7,107,993 | B2 | 9/2006 | Magidson |
| 7,123,733 | B1 | 10/2006 | Borowsky et al. |
| D535,644 | S | 1/2007 | Drambarean et al. |
| 7,185,655 | B1 | 3/2007 | Redon |
| D542,773 | S | 5/2007 | Drambarean et al. |
| 7,221,768 | B2 | 5/2007 | Sjursen et al. |
| D549,222 | S | 8/2007 | Huang |
| D550,201 | S | 9/2007 | Drambarean et al. |
| D550,567 | S | 9/2007 | Söderström |
| D550,655 | S | 9/2007 | Falco |
| 7,314,047 | B2 | 1/2008 | Falco |
| D563,945 | S | 3/2008 | Johns et al. |
| D565,022 | S | 3/2008 | Belliveau et al. |
| D567,217 | S | 4/2008 | Kamo et al. |
| D569,842 | S | 5/2008 | Yang |
| D575,767 | S | 8/2008 | Lee |
| D575,773 | S | 8/2008 | Yanai |
| D579,006 | S | 10/2008 | Kim et al. |
| 2002/0058881 | A1 | 5/2002 | Raviv et al. |
| 2002/0076057 | A1 | 6/2002 | Voix |
| 2003/0159878 | A1 | 8/2003 | Hakansson et al. |
| 2003/0172938 | A1 | 9/2003 | Falco |
| 2004/0047481 | A1 | 3/2004 | Bauman |
| 2004/0240691 | A1 | 12/2004 | Grafenberg |
| 2005/0018838 | A1 | 1/2005 | Meunier et al. |
| 2005/0111687 | A1 | 5/2005 | Lederer |
| 2005/0165460 | A1 | 7/2005 | Erfan |
| 2006/0050912 | A1 | 3/2006 | Kidd et al. |
| 2006/0050916 | A1 | 3/2006 | Wehner |
| 2006/0147072 | A1 | 7/2006 | Sodoma et al. |
| 2006/0159297 | A1 | 7/2006 | Wirola et al. |
| 2008/0187159 | A1 | 8/2008 | Blanchard |
| 2010/0098281 | A1* | 4/2010 | Urso et al. ..... 381/328 |
| 2011/0268308 | A1 | 11/2011 | Vasquez |

FOREIGN PATENT DOCUMENTS

| | | | |
|---|---|---|---|
| EP | 1681904 | A1 | 7/2006 |
| JP | 10023578 | A | 1/1998 |
| JP | 2000210327 | A | 8/2000 |
| WO | 9737593 | A1 | 10/1997 |
| WO | 9904601 | A1 | 1/1999 |
| WO | 0108443 | A2 | 2/2001 |
| WO | 2004077924 | A2 | 9/2004 |
| WO | 2005025268 | A1 | 3/2005 |
| WO | 2005112503 | A1 | 11/2005 |
| WO | 2006068772 | A2 | 6/2006 |

* cited by examiner

TEARDROP VARIABLE WALL EARBUD

INTRODUCTION

The inventions disclosed and claimed herein are earbuds that come in contact with the ear canal wall, adapted for use with earphones, stethoscopes, perytympanic hearing instruments (hearing aids), headsets, and ear plugs for hearing protection, and more particularly "in ear" applications. The devices to which the ear tips can be operatively attached are generally known in the art, including earphones that can be positioned on the head or over the ear, in the ear and wires capable of operatively connecting the ear tip to an audio source such as an analog or digital audio player. Alternative uses include operative attachment to stethoscopes, hearing aids, headsets, and as ear plugs.

DETAILED DESCRIPTION OF REPRESENTATIVE EMBODIMENTS

Figure 1:
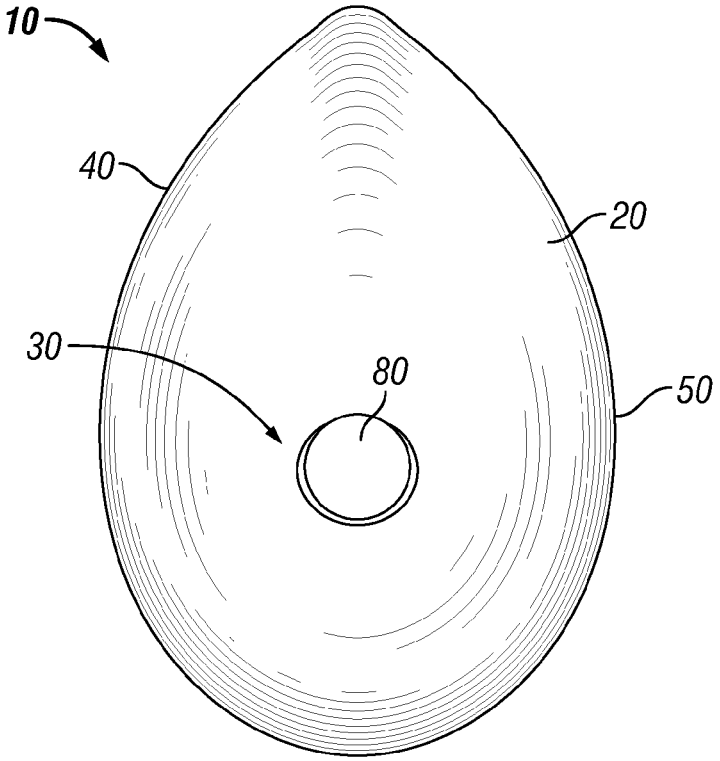
FIG. 1 shows a top view of one embodiment of an earbud.

For the purpose of promoting an understanding of the principles of the invention, reference is now made to the embodiments illustrated in the drawings and specific language is used to describe the same. No limitation of the scope of the invention is intended. Alterations and modifications to the illustrated devices, and other applications of the principles of the invention as illustrated herein are contemplated as would normally occur to one skilled in the art to which the invention relates.

Figure 2:
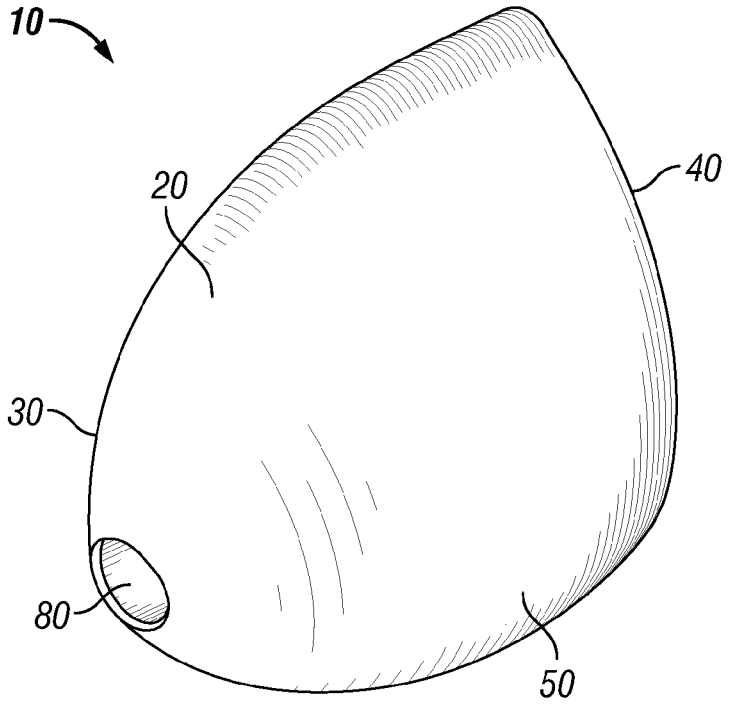
FIG. 2. shows a side perspective view of the earbud shown in FIG. 1.
Figure 3:
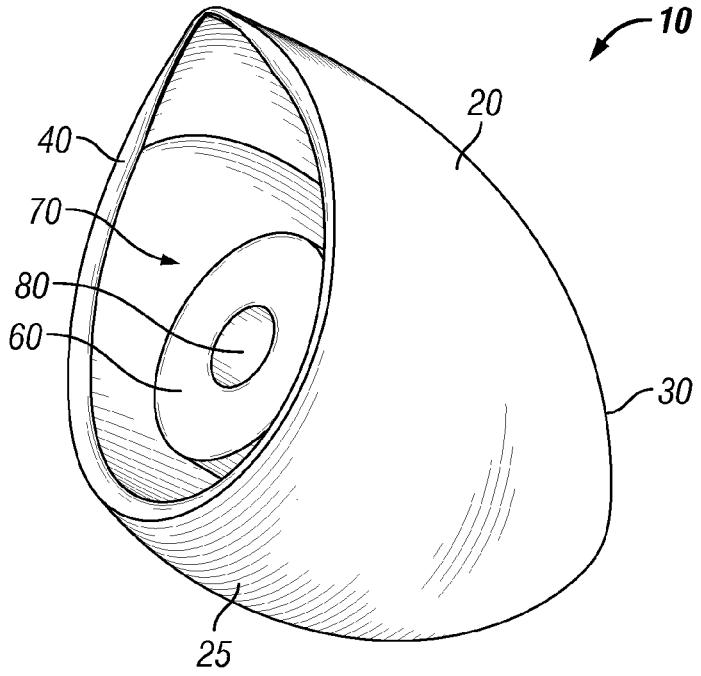
FIG. 3 shows a rear side perspective view of the earbud shown in FIG. 1.
Figure 4:
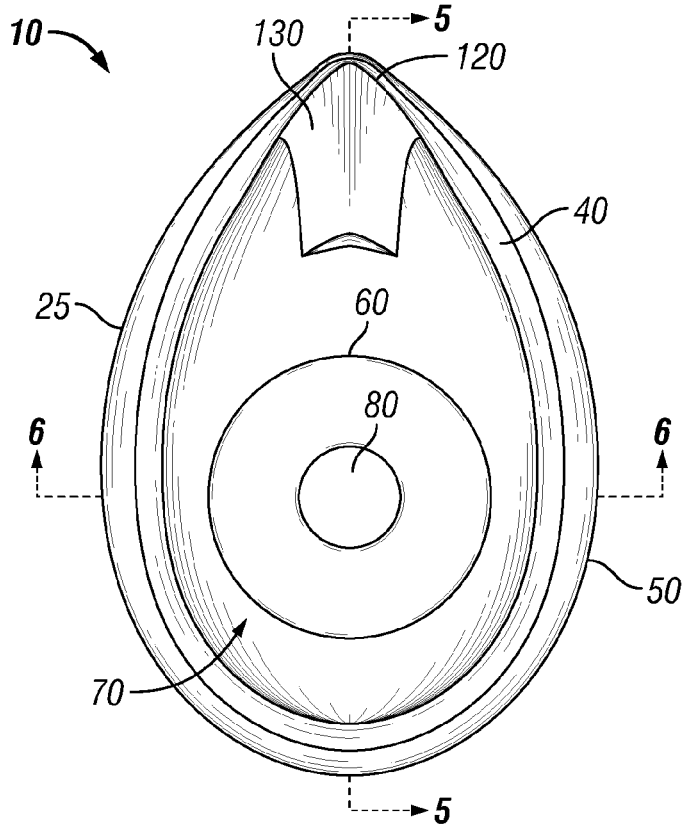
FIG. 4 shows a bottom view of the earbud shown in FIG. 1.
Figure 5:
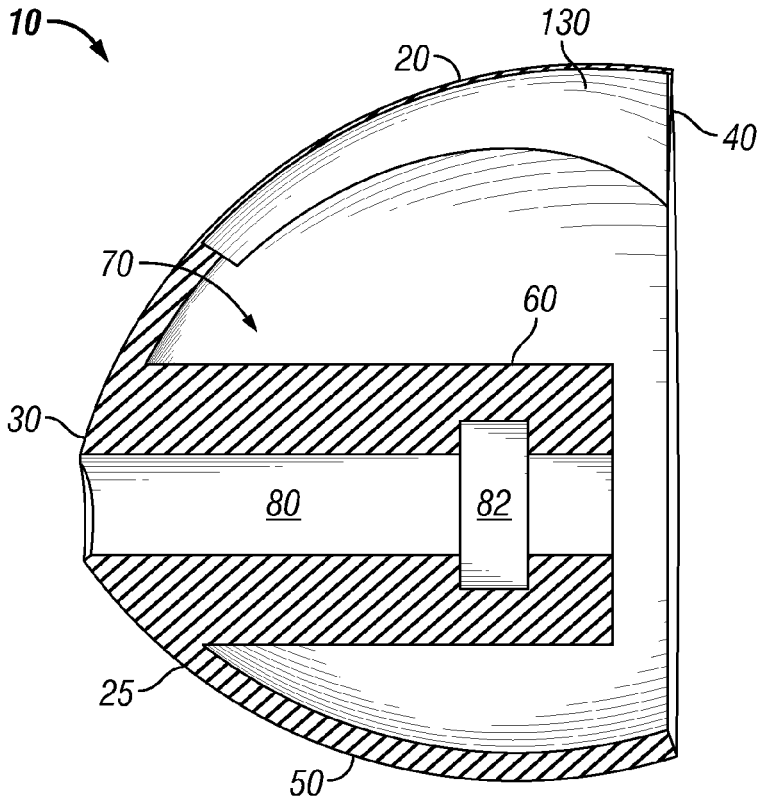
FIG. 5 shows a cross-section view of the earbud shown in FIG. 4 along axis A-A of FIG. 4.
Figure 6:
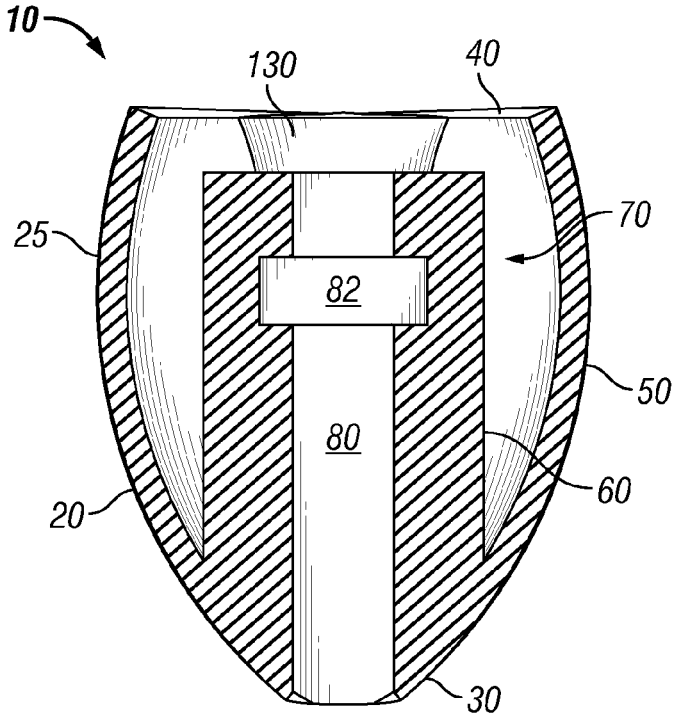
FIG. 6 shows a cross-section view of the earbud shown in FIG. 4 along axis B-B of FIG. 4.

As shown in FIGS. 1 and 2, the earbud or ear tip 10 has an annular flange 20 having a first or upper end 30, a second or lower end 40, and a teardrop curve or pear shaped lateral cross section 50 (shown for example in FIGS. 4-6). Referring collectively to FIGS. 3-6, an inner body 60 extends from the first end 30 toward the second end 40 within a chamber 70 defined by the annular flange 20. An acoustic channel 80 extends through the inner body 60 to connect operatively a sound source or transducer 90 (see FIG. 7) to the ear drum once the earbud 10 is positioned in a human ear. In this form, the inner body 60 has a generally circular shape, but other shapes could be used in other forms. Although the inner body 60 is illustrated as extending within the chamber 70 to a point just before the lower end 40, it should be appreciated that the inner body 60 could extend to the lower end 40 or outside of the lower end 40 in other forms.

As illustrated in FIGS. 3-6, the inner body 60 is formed as part of the flange 20. The inner body 60 is positioned so that its longitudinal axis is generally concentric with a portion of a longitudinal axis of the flange 20 (as shown in FIGS. 4-6). The acoustic channel 80 extends through the inner body 60 from the first end 30. A transducer 90 (see FIG. 7) may be positioned within the chamber 70 such that a portion of the transducer 90 is positioned within the acoustic channel 80 defined by the inner body 60. In one form, the inner body 60 includes a horizontal locking member or portion 82 that is used to help secure the transducer 90 to the inner body 60 of the earbud 10. The inner body 60 may be formed integrally with the flange 20 or as a separate piece which is then attached to the flange 20.

Figure 7:
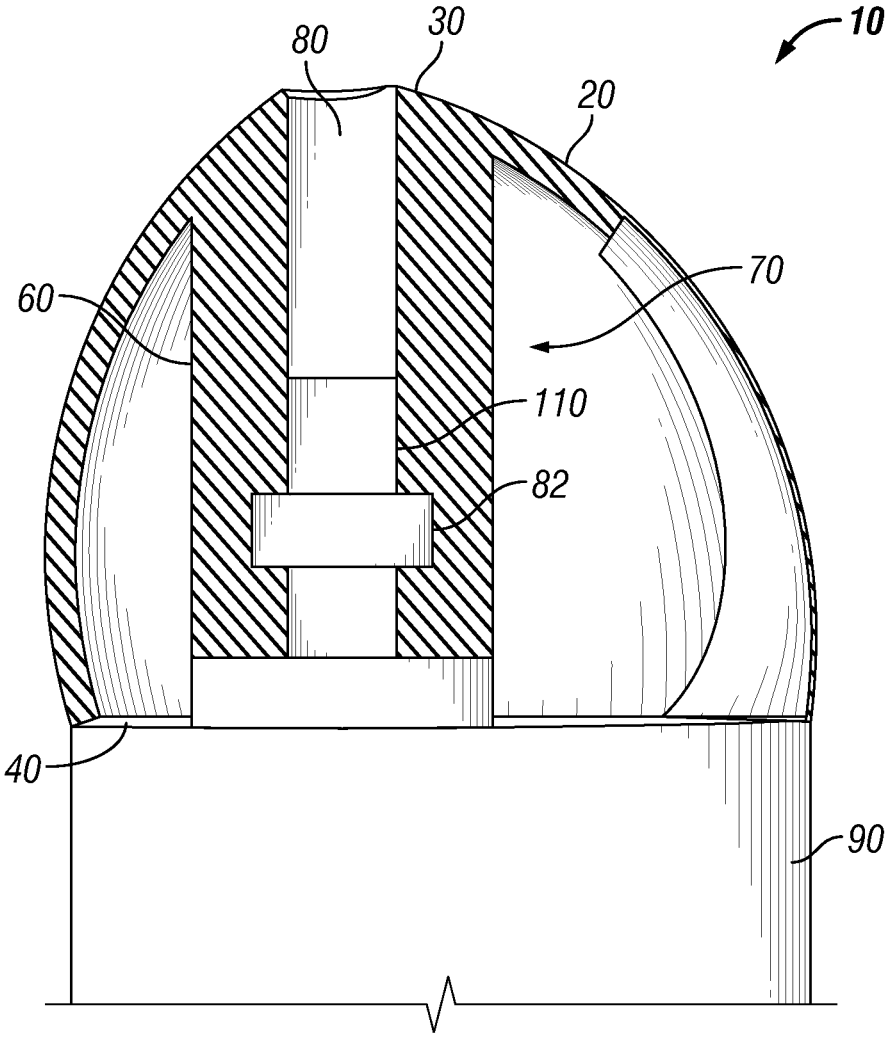
FIG. 7 shows a cross-section view of the earbud shown in FIG. 4 along axis A-A of FIG. 4 having a sound source connected to the earbud.

Referring to FIG. 7, an inner diameter 110 of the acoustic channel 80 is sized to secure an acoustic connection from a sound source or transducer 90. The acoustic channel 80 in one version has a diameter of about 1.26 millimeters. In another version, the acoustic channel 80 has a diameter of about 1.40 millimeters. Variations to the diameter of the acoustic channel 80 can be made without varying from the scope of the invention disclosed and claimed herein.

As illustrated in FIGS. 3-6, an exterior surface 25 of the flange 20 tapers upwardly from the lower end 40 to the upper end 30. In one form, the exterior surface 25 protrudes outwardly from the second end 40 such that the lateral cross-section is larger at portions as it tapers upwardly toward the first end 30. The arc of the taper can be constant or variable. In the illustrated form, the taper gets smaller as it approaches the upper end 30. Again, variations in the arc or radius of the taper can be made without varying from the scope of the invention disclosed and claimed herein.

Referring to FIG. 4, a bottom view of the earbud 10 is illustrated that shows that the lateral cross-section of the earbud 10 is generally formed in the shape of a teardrop curve. As the flange 20 transitions from the lower end 40 to the upper end 30, the earbud 10 has a lateral cross-section in the form of a teardrop curve. A teardrop curve is a plane curve given by the following parametric equations:

$$X=\cos t$$

$$Y=\sin t \sin^m(\tfrac{1}{2}t)$$

In other forms, the lateral cross-section shape of the curve could take the form of a Pearls of Sluze curve, which is a generalization of a teardrop curve.

Referring to FIGS. 4-6, at an apex portion 120 of the teardrop curve, a thickness of the flange 20 tapers to a narrower thickness from a larger thickness. This allows the apex portion 120 of the flange 20 to deform more readily when positioned within a human ear to conform more readily to the inner shape of a human ear. As illustrated best in FIGS. 4 and 5, this narrowing taper defines a notched out portion or hinge 130 in the interior of the flange 20 that begins at the lower end 40 of the flange and ends before reaching the upper portion 30 of the flange 20. The hinge 130 allows the earbud 10 to self-adjust or deform to fit the inner ear of the user.

Rigid, deformable, flexible, elastic or resilient materials provide flexibility in sizing the earbud, comfort, audio quality and durability. In one embodiment, the flange 20 is a polymer. In another embodiment, the flange 20 is an elastomeric polymer. In another form, the flange 20 is comprised of ABS plastic or polycarbonate plastic.

While the use of words such as preferable, preferably, preferred or more preferred utilized in the description indicate that the feature so described may be more desirable, such feature(s) may not be necessary. Embodiments lacking the same are within the scope of the invention as defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

I claim:

1. An ear tip, comprising:

a flange having an upper end and a lower end, wherein said flange has a teardrop curve lateral cross section running from approximately the upper end to the lower end, an inner body extending internally from the upper end within a hollow interior formed by the flange toward the lower end, wherein a thickness associated with said flange begins to narrow toward an apex portion of said teardrop curve, and an acoustic channel extending through the inner body, wherein the flange at least partially occludes an ear canal from ambient noise and creates at least a partial air seal in the ear canal and the acoustic channel is configured to allow the passage of sound into the ear canal when the inner body is connected with a sound source, wherein said narrowing thickness at said apex portion of said teardrop curve forms a hinge in said flange that allows said flange to self-adjust to fit an inner ear of a user.

2. The ear tip of claim 1 wherein said flange tapers to the lower end from the upper end.

3. The ear tip of claim 1 wherein said flange tapers outwardly from the lower end and then back inwardly to the upper end from the lower end.

4. The ear tip of claim 1 wherein said hinge begins at said lower end and ends prior to reaching said upper end and is located on an interior surface of said flange.

5. The ear tip of claim 1 wherein the flange comprises a substantially rigid material.

6. The ear tip of claim 1 wherein the flange comprises a flexible material.

7. The ear tip of claim 1 wherein the flange comprises a deformable material.

8. The ear tip of claim 1 wherein the flange comprises an elastic material.

9. The ear tip of claim 1 wherein the flange comprises a resilient material.

10. An ear tip, comprising:

a flange having an upper end tapering downwardly to a lower end and having a non-circular lateral cross-section, wherein a thickness associated with said flange narrows towards an apex portion of said flange thereby forming a narrowing taper, wherein said narrowing taper at said apex portion of said flange forms a notched out portion in an interior of said flange, an inner body extending internally from the upper end within a hollow interior formed by the flange toward the lower end, and an acoustic channel extending through the inner body, where the flange at least partially occludes an ear canal from ambient noise and creates at least a partial air seal in the ear canal and the acoustic channel is configured to allow the passage of sound into the ear canal when the inner body is connected with a sound source.

11. The ear tip of claim 10 wherein said non-circular lateral cross-section comprises a teardrop curve.

12. The ear tip of claim 10 wherein said non-circular lateral cross-section comprises a Pearls of Sluze curve.

13. The ear tip of claim 10 wherein said notched out portion begins at said lower end and ends prior to reaching said upper end and is located on an interior surface of said flange.

* * * * *